US010182694B2

(12) United States Patent
Lee et al.

(10) Patent No.: US 10,182,694 B2
(45) Date of Patent: Jan. 22, 2019

(54) VACUUM CLEANER

(71) Applicant: LG ELECTRONICS INC., Seoul (KR)

(72) Inventors: Soongkeun Lee, Seoul (KR); Chungill Lee, Seoul (KR); Seongwoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 25 days.

(21) Appl. No.: 15/235,287

(22) Filed: Aug. 12, 2016

(65) Prior Publication Data

US 2017/0042400 A1 Feb. 16, 2017

(30) Foreign Application Priority Data

Aug. 13, 2015 (KR) ..... 10-2015-0114371

(51) Int. Cl.

| | |
|---|---|
| ***A47L 9/28*** | (2006.01) |
| ***A47L 9/14*** | (2006.01) |
| ***A47L 9/10*** | (2006.01) |
| ***A47L 9/26*** | (2006.01) |
| ***A47L 5/36*** | (2006.01) |

(52) U.S. Cl.

CPC ..... *A47L 9/2842* (2013.01); *A47L 5/36* (2013.01); *A47L 9/102* (2013.01); *A47L 9/1409* (2013.01); *A47L 9/26* (2013.01); *A47L 9/2878* (2013.01); *A47L 9/2884* (2013.01)

(58) Field of Classification Search

CPC ..... A47L 9/2842; A47L 5/36; A47L 9/102; A47L 9/1409; A47L 9/26; A47L 9/2878

See application file for complete search history.

(56) References Cited

U.S. PATENT DOCUMENTS 5,243,732 A 9/1993 Koharagi et al.
6,307,358 B1 * 10/2001 Conrad ..... A47L 5/32 323/282
6,448,732 B1 * 9/2002 Block ..... A47L 9/2842 15/339

(Continued)

FOREIGN PATENT DOCUMENTS

CN 1830376 9/2006
CN 101677734 3/2010

(Continued)

OTHER PUBLICATIONS

Taiwanese Office Action dated May 25, 2017 issued in Application No. 105125350.

(Continued)

*Primary Examiner* — Dung Van Nguyen
(74) *Attorney, Agent, or Firm* — Ked & Associates, LLP

(57) ABSTRACT

A vacuum cleaner may include a cleaner body having a suction motor and a suctioning portion configured to be in communication with the cleaner body and to suction air and dust. One of a battery assembly having a battery or a cord reel assembly having a power cord may be installed in the cleaner body. The vacuum cleaner may also include a controller to control the suction motor by modifying a pulse width modulation (PWM) duty cycle of an inverter providing power to the suction motor based on whether the battery assembly or the cord reel assembly is installed in the cleaner body.

13 Claims, 7 Drawing Sheets

(56) References Cited

U.S. PATENT DOCUMENTS

| | | | | |
|---|---|---|---|---|
| 6,611,989 | B2 * | 9/2003 | Oh | A47L 9/00 15/323 |
| 6,798,162 | B2 | 9/2004 | Makaran et al. | |
| 7,122,982 | B2 | 10/2006 | Sasaya et al. | |
| 7,526,833 | B2 | 5/2009 | Cochran et al. | |
| 7,847,511 | B2 * | 12/2010 | Yoo | A47L 9/2831 318/254.1 |
| 7,898,209 | B2 * | 3/2011 | Kim | A47L 9/2805 318/139 |
| 7,932,688 | B2 * | 4/2011 | Han | A47L 9/2805 318/254.1 |
| 8,146,199 | B2 | 4/2012 | Yoo et al. | |
| 9,742,319 | B2 | 8/2017 | Marvelly et al. | |
| 2006/0204383 | A1 | 9/2006 | Kushida et al. | |
| 2016/0233810 | A1 * | 8/2016 | Williams | H02J 7/0027 |

FOREIGN PATENT DOCUMENTS

| | | |
|---|---|---|
| CN | 102460947 | 5/2012 |
| CN | 204046485 | 12/2014 |
| JP | H 05-192270 | 8/1993 |
| JP | 2001-321306 | 11/2001 |
| JP | 2002-034862 | 2/2002 |
| JP | 2003-526531 | 9/2003 |
| KR | 10-2006-0034851 | 4/2006 |
| KR | 10-2010-0041794 | 4/2010 |
| TW | 480164 | 3/2002 |
| TW | 572746 | 1/2004 |
| TW | 200418427 | 10/2004 |
| WO | WO 2005/099547 | 10/2005 |

OTHER PUBLICATIONS

Korean Office Action dated Jun. 10, 2016 issued in Application No. 10-2015-0114371.

Korean Office Action dated Dec. 29, 2016 issued in Application No. 10-2015-0114371.

European Search Report dated Jan. 10, 2017 issued in Application No. 16183549.1.

Korean Office Action dated Mar. 6, 2017 issued in Application No. 10-2015-0114371.

* cited by examiner

VACUUM CLEANER

CROSS-REFERENCE TO RELATED APPLICATION(S)

This application claims priority under 35 U.S.C. § 119 to Korean Patent Application No. 10-2015-0114371, filed on Aug. 13, 2015, whose entire disclosure is hereby incorporated by reference.

BACKGROUND

1. Field

A vacuum cleaner is disclosed herein.

2. Background

Generally, a vacuum cleaner is an apparatus which suctions air containing dust using a suction force generated by a suction motor installed inside a main body, and filters the dust in the main body. The vacuum cleaner is classified into a manual cleaner or an automatic cleaner. The manual cleaner is a cleaner with which a user directly performs a cleaning operation, and the automatic leaner is a cleaner which performs the cleaning operation while traveling by oneself. The manual cleaner may be classified into a canister type in which a suction nozzle is provided separately from a main body and connected with the main body through a connection tube, and an upright type in which the suction nozzle is coupled to the main body.

In Korean Patent Publication No. 2006-0034851 (published on Apr. 26, 2006), there is disclosed a wire and wireless vacuum cleaner (hereinafter, referred to as a "vacuum cleaner"). The vacuum cleaner disclosed in the reference includes a battery and a cord reel, and a vacuum suction motor which may simultaneously use a battery power source of DC power and an external power source of AC power is installed therein. And the vacuum cleaner further includes a cord reel door, and an AC/DC switch. The AC/DC switch is switched to an AC power mode when the cord reel door is opened, and switched to a DC power mode when cord reel door is closed.

According to the reference, since the vacuum cleaner includes both the battery and the cord reel, there is a problem that the vacuum cleaner is heavy. Also, since the AC mode or the DC mode should be switched using the AC/DC switch, there is another problem that a manufacturing cost is increased, and a structure thereof is complicated. Also, since a cord reel door opening detecting sensor for detecting opening and closing of the cord reel door should be provided to switch the modes, there is still another problem that the manufacturing cost is further increased, and the structure thereof is further complicated.

The above reference is incorporated by reference herein where appropriate for appropriate teachings or additional or alternative details, features, and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
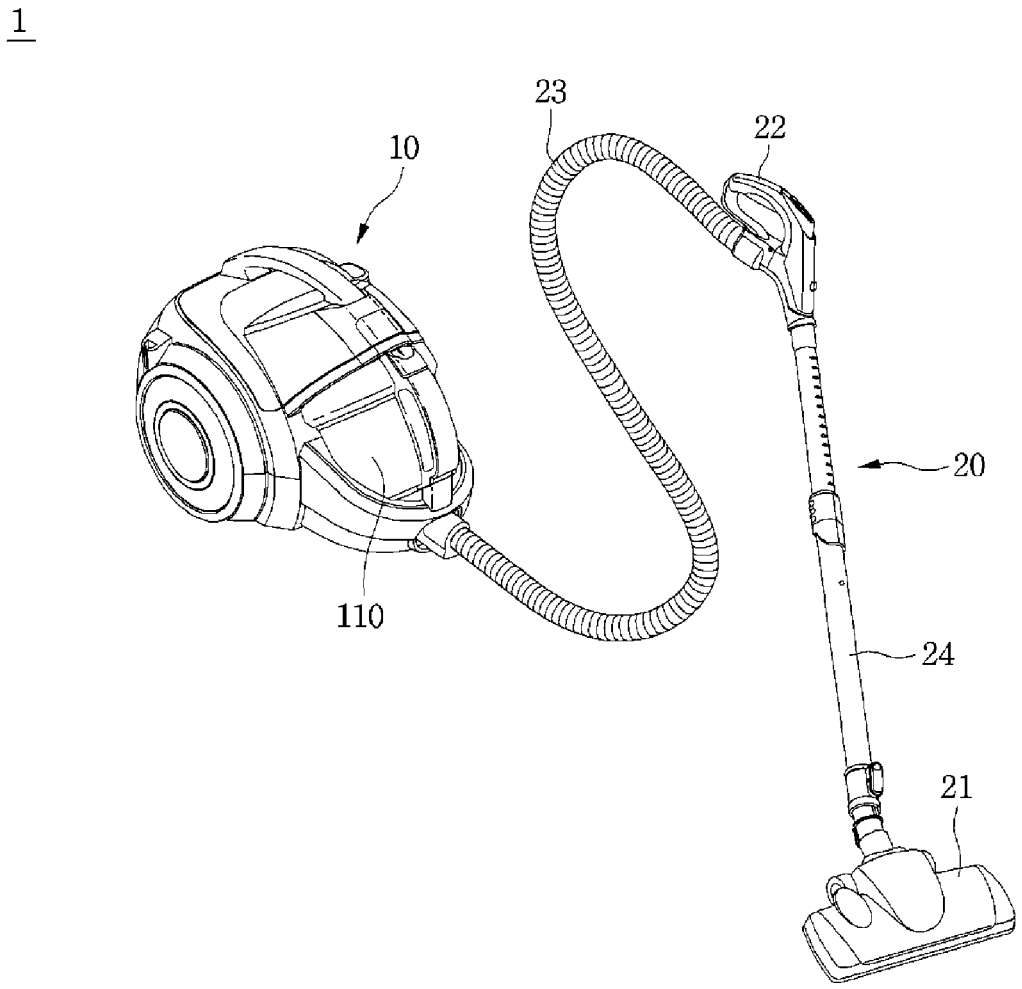
FIG. 1 is a perspective view of a vacuum cleaner according to an embodiment of the present disclosure.
Figure 2:
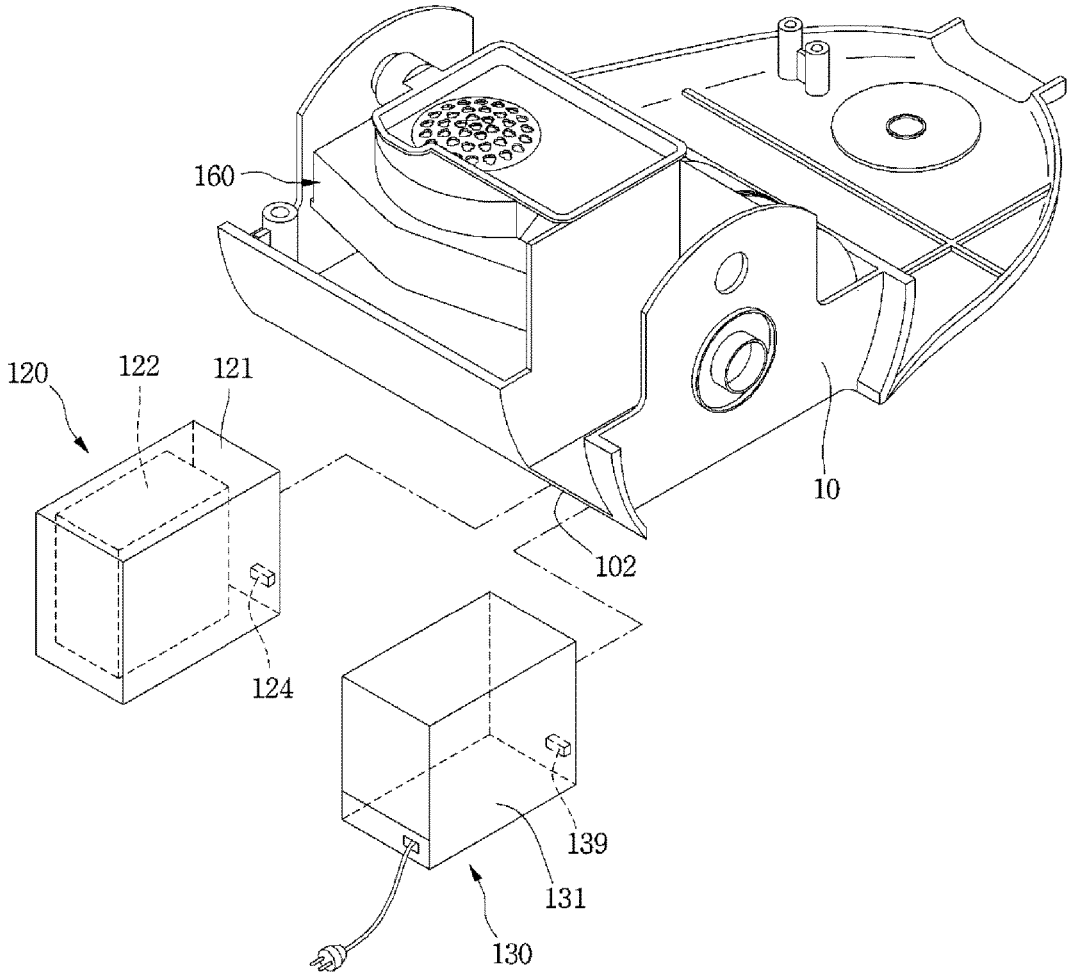
FIG. 2 is a view illustrating a state in which a battery assembly or a cord reel assembly is separated from the vacuum cleaner according to the embodiment of the present disclosure.
Figure 3:
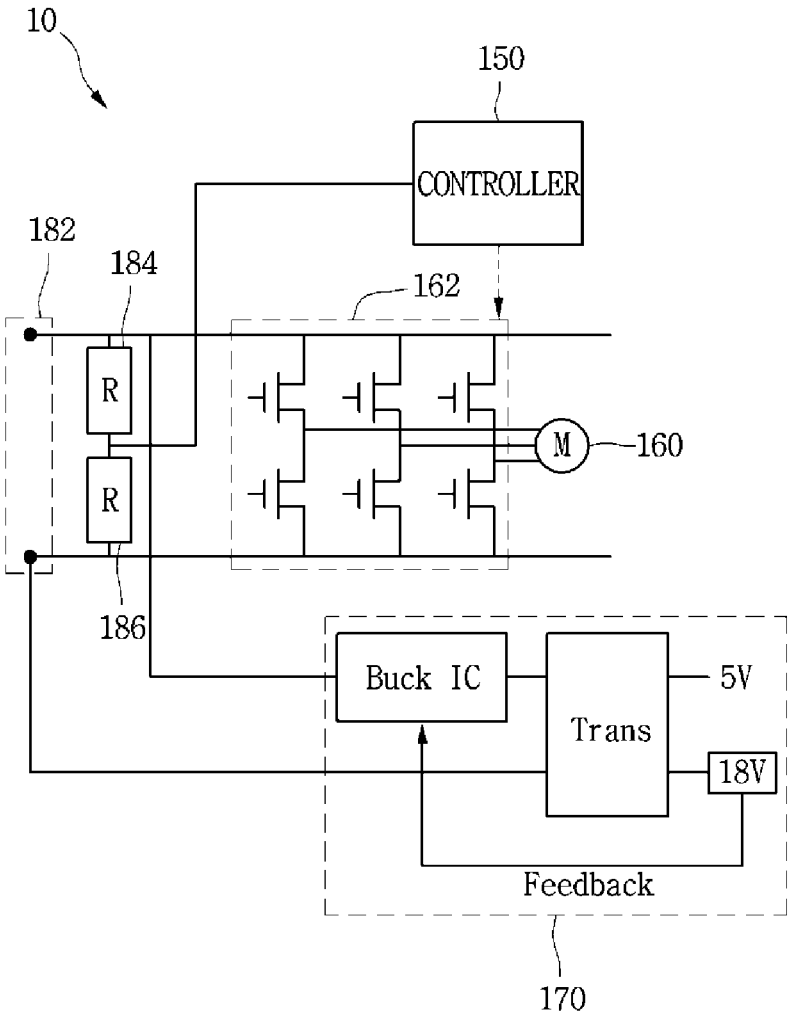
FIG. 3 is a circuit diagram illustrating a configuration of the vacuum cleaner according to the embodiment of the present disclosure.
Figure 4:
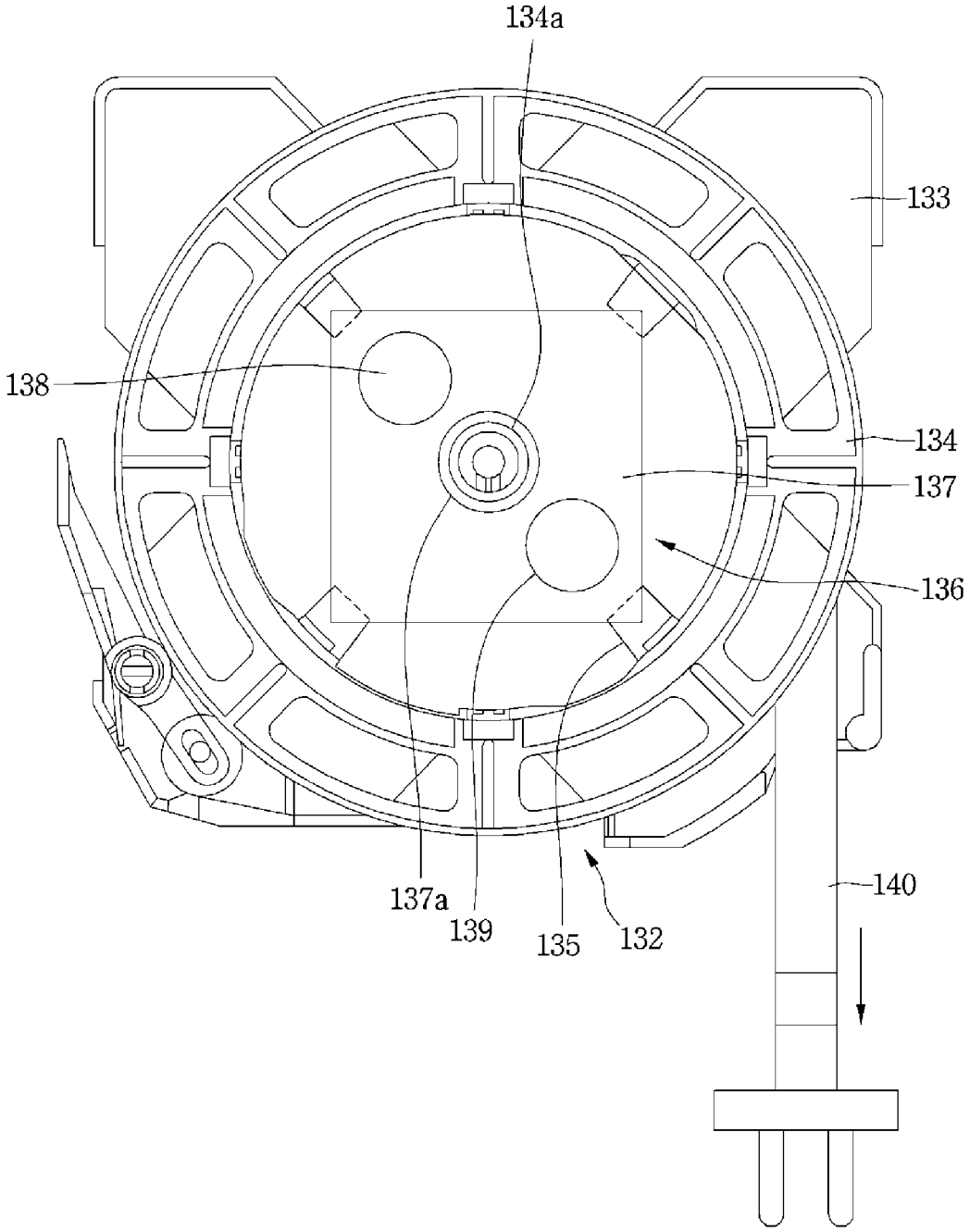
FIG. 4 is a view illustrating a structure of the cord reel assembly according to the embodiment of the present disclosure.

Referring to FIGS. 1 to 4, a vacuum cleaner 1 according to an embodiment of the present disclosure may include a cleaner body 10 having a suction motor 160 which generates a suction force, and a suction unit 20 which guides air containing dust to the cleaner body 10. As an example, FIG. 4 illustrates a state in which a cord reel case is removed from a cord reel assembly.

The suction unit 20 may include a suctioning portion (or cleaner head) 21 which suctions the dust on a surface to be cleaned, e.g., a floor surface, and connecting portions 22, 23 and 24 which connects the suctioning portion 21 to the cleaner body 10. The connecting portions 22, 23 and 24 may include an extension pipe 24 which is connected to the suctioning portion 21, a handle 22 which is connected to the extension pipe 24, and a suction hose 23 which connects the handle 22 to the cleaner body 10.

And the vacuum cleaner 1 may further include a dust separator (not shown) which separates the dust from the air suctioned from the suction unit 20, and a dust container 110 which stores the dust separated in the dust separator. The dust container 110 may be separably installed at the cleaner body 10. The dust separator is manufactured as a separate part from the dust container 110, or may be integrally formed as one module with the dust container 110.

The vacuum cleaner 1 may further include an installing portion (or recess) 102. One of a battery assembly 120 or a cord reel assembly 130 may be installed at the installing portion 102. The battery assembly 120 or the cord reel assembly 130 may serve as a power supply source. Therefore, according to the embodiment, one of a plurality of power supply sources may be selectively installed at the vacuum cleaner 1. When one of the battery assembly 120 or the cord reel assembly 130 is installed at the installing portion 102, a voltage output from the assembly installed at the installing portion 102 may be supplied to the suction motor 160.

The vacuum cleaner 1 may further include a controller 150 which controls the suction motor 160. Also, the vacuum cleaner 1 may include an inverter 162 which supplies the voltage output from the assembly installed at the installing portion 102 to the suction motor 160 to be usable in the suction motor 160. The inverter 162 may include a plurality of switching elements, and the controller 150 may output a switching signal relative to the plurality of switching elements. At this point, the switching signal may be a pulse width modulation (PWM) signal which controls a PWM voltage duty factor of the inverter 162.

At this point, the controller 150 may control an operation of the inverter 162 based on the voltage output from the assembly installed at the installing portion 102. That is, a control method of the inverter 162 when the battery assembly 120 is installed at the installing portion 102 is different from that of the inverter 162 when the cord reel assembly 130 is installed at the installing portion 102.

The battery assembly 120 may include a battery case 121 which forms an exterior, and a battery 122 which is accommodated in the battery case 121. The battery 122 is not limited, but may include a plurality of battery cells. The plurality of battery cells may be secondary cells which are dischargeable and rechargeable, and may be connected to each other in series. And a battery terminal 124 may be provided at one side of the battery case 121.

The cleaner body 10 may further include a body terminal 182 which may be connected to the battery terminal 124. The battery terminal 124 may be disposed at the installing portion 102 when the battery assembly 120 is received within the installing portion 102.

The cord reel assembly 130 may include a cord reel case 131 which forms an exterior, and a cord reel unit 132 which is accommodated in the battery case 121. And a cord reel terminal 139 which may be connected to the body terminal 182 may be provided at one side of the cord reel case 131.

Therefore, when one of the battery assembly 120 or the cord reel assembly 130 is installed at the installing portion 102, it may be connected to the body terminal 182, and thus the cleaner body 10 may receive a voltage from the installed one of the battery assembly 120 or the cord reel assembly 130.

The cord reel unit 132 may include a rotating member 134 on which a power cord 140 is wound, and a base 133 which rotatably supports the rotating member 134. In the embodiment, since a configuration for rotating the rotating member 134 at the cord reel unit 132 may be realized by a well-known structure, hereinafter, only a characteristic portion of the embodiment will be described.

The power cord 140 may be connected to an electrical outlet disposed at a wall surface or the like. When the power cord 140 is connected to the electrical outlet, the cord reel assembly 130 receives a commercial AC voltage.

In the embodiment, the cord reel assembly 130 may output a DC voltage to the cleaner body 10 to simplify a circuit configuration in the cleaner body 10. To this end, the cord reel assembly 130 may further include an AC/DC converter 136 which converts an AC voltage into a DC voltage.

The AC/DC converter 136 is electrically connected to the power cord 140 and the battery terminal 124, and converts an AC voltage supplied from an outside into a DC voltage. The AC/DC converter 136 may be located at a space formed at a central portion of the rotating member 134. The AC/DC converter 136 may include a printed circuit board 137, and a diode 138 and a capacitor which are mounted on the printed circuit board 137.

A hole 137*a* through which a rotating shaft 134*a* passes to enable rotation of the rotating member 134 relative to the base 133 may be formed at the printed circuit board 137. A fixing portion (or stopper) 135 to which the printed circuit board 137 is fixed may be provided at the base 133. Therefore, according to the embodiment, even when the rotating member 134 is rotated, the AC/DC converter 136 may be maintained in a fixed state to the base 133, and the rotating member 134 may be rotated without interference with the AC/DC converter 136.

Although not illustrated, the power cord 140 may pass through the rotating shaft 134*a*, and may be connected to the AC/DC converter 136. Therefore, even when the rotating member 134 is rotated, the power cord 140 may be maintained in a connected state to the AC/DC converter 136.

In one example, cord reel assembly 130 may be integrated into vacuum cleaner 1, and vacuum cleaner 1 may selectively receive battery assembly 120 in installing portion 102. In another example, vacuum cleaner 1 may include two installing portion 102 that selectively receive both battery assembly 120 and cord reel assembly 130. In these examples, vacuum cleaner 1 may selectively use input power from either battery assembly 120 or cord reel assembly 130, such as switching between battery assembly 120 and cord reel assembly 130 based on a user input. As described below, controller 150 may modify the operation of inverter 162 based on whether battery assembly 120 or cord reel assembly 130 is actively providing power.

Meanwhile, the vacuum cleaner 1 may further include a power supply controller 170. The power supply controller 170 may output a constant voltage which will be supplied to a power consumption unit other than the suction motor 160 regardless of a type of the assembly installed at the installing portion 102.

The vacuum cleaner 1 may include a plurality of distribution resistors 184 and 186 which are used to determine the type of the assembly connected to the body terminal 182. The distribution resistors 184 and 186 may be connected to both ends of the body terminal 182 in series, and the controller 150 may detect a voltage between the plurality of distribution resistors 184 and 186, and may determine the type of the assembly connected to the body terminal 182. Hereinafter, controlling of the inverter 162 of the controller 150 according to the type of the assembly connected to the vacuum cleaner 1 will be described.

Figure 5:
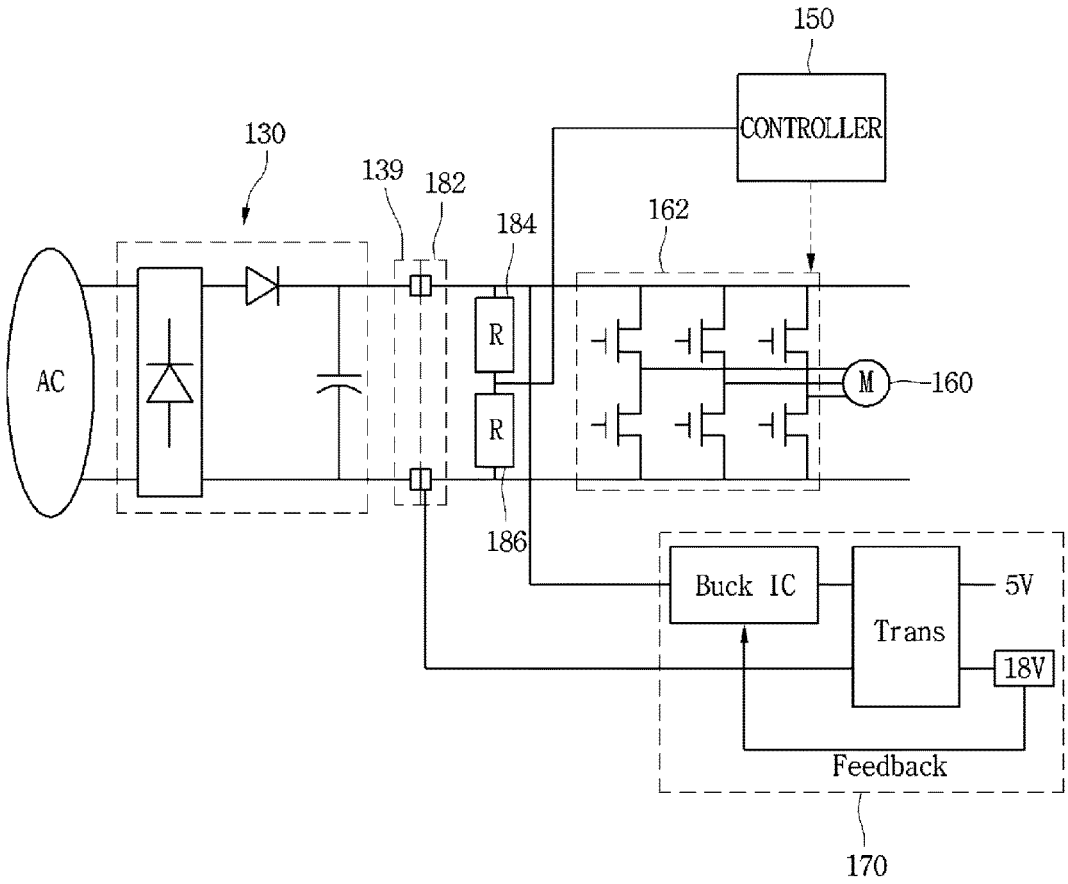
FIG. 5 is a circuit diagram illustrating a state in which the cord reel assembly is connected to the vacuum cleaner.
Figure 6:
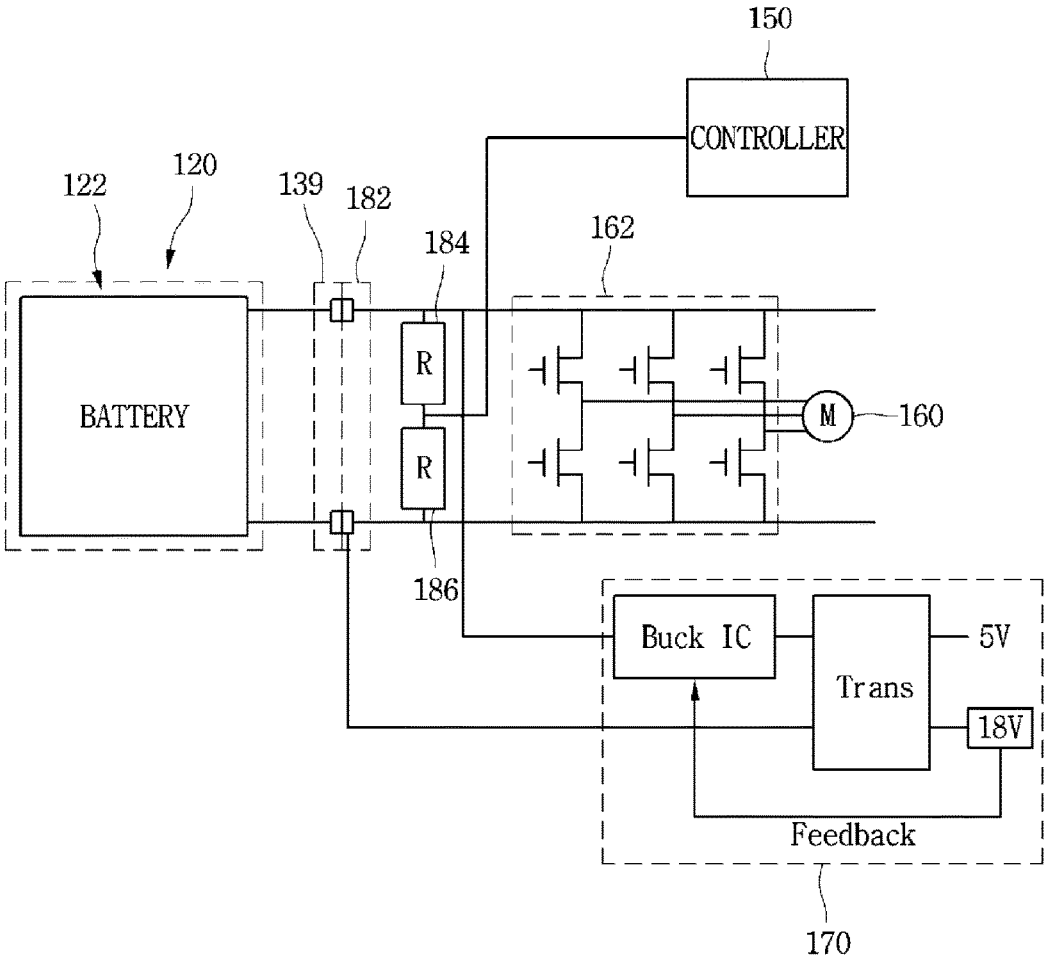
FIG. 6 is a circuit diagram illustrating a state in which the battery assembly is connected to the vacuum cleaner.
Figure 7:
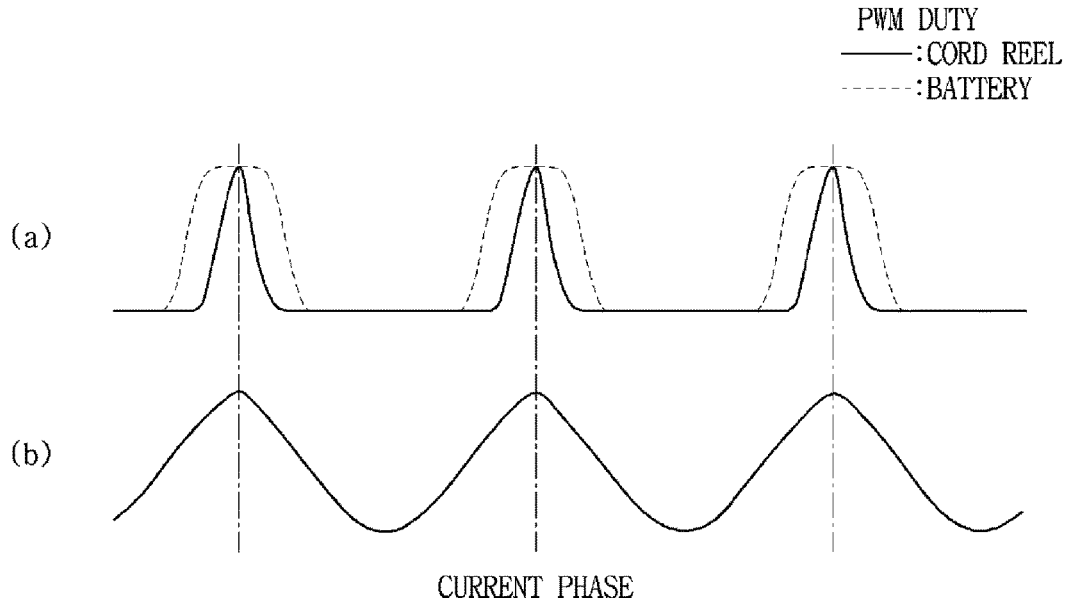
FIG. 7 shows graphs illustrating a PWM duty of an inverter according to a type of a power supply source.

Referring to FIGS. 5 to 7, a user may install one of the battery assembly 120 and the cord reel assembly 130 at the installing portion 102 of the cleaner body 10. FIG. 7*a* illustrates the PWM duty cycle of the inverter 162 according to the type of the power supply source, and FIG. 7*b* illustrates a waveform of a current applied to the suction motor.

When the battery assembly 120 is installed at the cleaner body 10, a moving distance of the vacuum cleaner 1 is not limited, and also since it is not necessary to move over the power cord wound on the cord reel or to arrange the power cord while the vacuum cleaner 1 is moved, the vacuum cleaner 1 may be smoothly moved. When the cord reel assembly 130 is installed at the cleaner body 10, the moving distance of the vacuum cleaner 1 is limited, but the user may continuously use the vacuum cleaner 1 without a limit to a use time as the user wants.

When the user installs the battery assembly 120 at the cleaner body 10, a DC voltage may be supplied from the battery assembly 120 to the cleaner body 10. At this point, a maximum DC voltage output from the battery assembly 120 may be referred to as a first voltage. When the battery assembly 120 is installed at the installing portion 102, the controller 150 may detect installation of the battery assembly 120, and thus may output a signal having a first PWM duty cycle for controlling the inverter 162.

However, when the user installs the cord reel assembly 130 at the cleaner body 10, a DC voltage may be supplied from the cord reel assembly 130 to the cleaner body 10. At this point, a maximum DC voltage output from the cord reel assembly 130 may be referred to as a second voltage.

In the embodiment, the second voltage may be greater than the first voltage. Since an intensity of the first voltage is different from that of the second voltage, the controller 150 may determine the type of the assembly 120 or 130 connected to the cleaner body 10. When the cord reel assembly 130 is installed at the installing portion 102, the controller 150 may detect installation of the cord reel assembly 130, and thus may output a signal having a second PWM duty cycle for controlling the inverter 162.

Referring to FIG. 7, when it is intended to rotate the suction motor 160 at a certain rotation speed regardless of the type of the power supply source, the first PWM duty cycle in the case in which the battery assembly 120 is installed is set greater than the second PWM duty cycle in the case in which the cord reel assembly 130 is installed.

In the embodiment, the PWM duty cycle may be defined as a ratio of a sum of a switching-on time and a switching-off time with respect to the switching-on time when the switch is on or off. In one embodiment, since the second voltage which is the maximum output voltage of the cord reel assembly 130 is greater than the first voltage which is the maximum output voltage of the battery assembly 120, the PWM duty cycle used when the cord reel assembly 130 is installed may be controlled to be smaller than the PWM duty cycle used when the battery assembly 120 is installed. Therefore, according to the present disclosure, the suction motor 160 may be rotated at a certain desired rotation speed, regardless of the installed type of the power supply source by modifying the PWM duty cycle.

In another example, the voltage output from the battery assembly 120 may be reduced as an operation time of the suction motor 160 is increased. In this case, if the PWM duty cycle is constantly maintained, an output of the suction motor 160 may be reduced. Therefore, in the embodiment, when the voltage output from the battery assembly 120 reaches a reference voltage, or when a use time of the suction motor 160 reaches a reference time, the controller 150 may increase the PWM duty cycle.

Since the user may select the power supply source based on an estimated time of a cleaning operation or an amount of foreign substances, it is possible to satisfy various user tastes and to enhance user convenience. Also, since each of the battery assembly and the cord reel assembly outputs a DC power, and thus the switch for switching the power supply mode to the vacuum cleaner may not be provided, a structure of the vacuum cleaner is simplified, and a manufacturing cost is reduced, and a program built in the vacuum cleaner is also simplified. That is, an algorithm which controls the switch for switching the power supply mode can be removed.

Also, since one of two power supply sources can be selected, and then can be installed at the vacuum cleaner, a weight of the vacuum cleaner can be reduced, and thus the user can easily move the vacuum cleaner. Also, even though the type of the power supply source is different, one motor can be used by that the controller varies the PWM duty cycle for controlling the inverter according to the type of the power supply source. Also, since the battery assembly can be separated from the vacuum cleaner, the entire battery assembly or the entire battery cell can be easily replaced.

Even though all the elements of the embodiments are coupled into one or operated in the combined state, the present disclosure is not limited to such an embodiment. That is, all the elements may be selectively combined with each other without departing the scope of the disclosure. Furthermore, when it is described that one comprises (or comprises or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

A vacuum cleaner in which a cord reel assembly or a battery assembly is selectively installed is described herein. The vacuum cleaner may include a cleaner body having a suction motor; a suctioning portion configured to be in communication with the cleaner body and to suction air and dust; an installing portion provided at the cleaner body; a battery assembly separably installed at the installing portion, and having a battery; a cord reel assembly separably installed at the installing portion to replace the battery assembly, and having a power cord; a controller configured to control the suction motor based on the assembly installed at the installing portion; and an inverter configured to supply a voltage received from the assembly installed at the installing portion to the suction motor, wherein, when the battery assembly is installed at the installing portion, and the suction motor is operated, and an operation time of the suction motor passes a predetermined time, or the voltage output from the battery assembly reaches a reference voltage, the controller increases a PWM duty for controlling the inverter.

The battery assembly and the cord reel assembly may output a DC voltage. The controller may vary the PWM duty of the inverter according to a type of the assembly installed at the installing portion. The controller may output a signal having a first PWM duty when it is determined that the battery assembly is installed at the installing portion, and may output a signal having a second PWM duty when it is determined that the cord reel assembly is installed at the installing portion. The DC voltage output from the cord reel assembly may be greater than that output from the battery assembly. The first PWM duty may be greater than the second PWM duty.

A body terminal may be provided at the installing portion, and a battery terminal which is connected to the body terminal may be provided at the battery assembly, and a cord reel terminal which is connected to the body terminal may be provided at the cord reel assembly. Each of the battery assembly and the cord reel assembly may output a DC voltage to the body terminal.

The cord reel assembly may include an AC/DC converter for converting an AC voltage into the DC voltage. The AC/DC converter may be electrically connected to the power cord and the cord reel terminal. The cord reel assembly may include a base and a rotating member which is rotatable relative to the base by a rotating shaft and on which the power cord is wound, and the AC/DC converter may be disposed at a space formed at a central portion of the rotating member. The AC/DC converter may include a printed circuit board, and the printed circuit board may be installed at the base, and may have a hole through which the rotating shaft passes. The vacuum cleaner may further include a plurality of distribution resistors which are connected to both ends of the body terminal, and the controller may determine the type of the assembly installed at the installing portion based on a voltage between the plurality of distribution resistors.

A vacuum cleaner may include a suction motor configured to generate a suctioning force; a cleaner body having a suction motor; a suctioning portion configured to guide air and dust to the cleaner body; a connecting portion configured to connect the suctioning portion to the cleaner body; an installing portion provided at the cleaner body; a battery assembly separably installed at the installing portion, and having a battery; a controller configured to control the suction motor; and an inverter configured to supply a voltage received from the battery assembly to the suction motor, wherein the controller increases a PWM duty for controlling the inverter, and prevents an output of the suction motor from being reduced.

The controller may increase the PWM duty according to an operation time of the suction motor or an output voltage of the battery assembly. The controller may increase the PWM duty when the operation time of the suction motor passes a reference time. The controller may increase the PWM duty when the output voltage of the battery assembly reaches a reference voltage.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner comprising:

a cleaner body having a suction motor, a cleaner head configured to be in communication with the cleaner body and to suction air and dust, a recess provided in the cleaner body and configured to selectively receive a battery assembly that has a battery, and to selectively receive a cord reel assembly that has a power cord to replace the battery assembly;

a controller configured to control the suction motor based on whether the battery assembly or the cord reel assembly is installed in the recess; and an inverter configured to supply a voltage received from one of the battery assembly or the cord reel assembly installed in the recess to the suction motor, wherein the battery assembly and the cord reel assembly output respective direct current (DC) voltages, wherein the controller varies a pulse width modulation (PWM) duty of the inverter according to the one of the battery assembly or the cord reel assembly installed in the recess, and wherein the controller outputs a signal having a first PWM duty when the battery assembly is installed in the recess, and outputs a signal having a second PWM duty when the cord reel assembly is installed in the recess.

2. The vacuum cleaner according to claim 1, wherein the DC voltage that is output from the cord reel assembly is greater than the DC voltage that is output from the battery assembly.

3. The vacuum cleaner according to claim 2, wherein the first PWM duty is greater than the second PWM duty.

4. The vacuum cleaner according to claim 1, wherein a body terminal is provided in the recess, a battery terminal which connects to the body terminal is provided at the battery assembly, and a cord reel terminal which connects to the body terminal is provided at the cord reel assembly.

5. The vacuum cleaner according to claim 4, wherein each of the battery assembly and the cord reel assembly outputs DC voltage to the body terminal.

6. The vacuum cleaner according to claim 5, wherein the cord reel assembly comprises an AC/DC converter for converting an AC voltage into the DC voltage for the cord reel assembly.

7. The vacuum cleaner according to claim 6, wherein the AC/DC converter is electrically connected to the power cord and the cord reel terminal.

8. The vacuum cleaner according to claim 1, wherein, when the battery assembly is installed in the recess, the suction motor is operated, and either an operation time of the suction motor passes a predetermined time, or the voltage output from the battery assembly reaches a reference voltage, the controller increases the pulse width modulation (PWM) duty for controlling the inverter.

9. The vacuum cleaner according to claim 1, wherein the controller determines whether the battery assembly or the cord reel assembly is connected to the recess based on respective magnitudes of the voltage output from the cord reel assembly and the battery assembly.

10. The vacuum cleaner according to claim 9, wherein a maximum DC voltage output from the cord reel assembly is greater than a maximum DC voltage output from the battery assembly.

11. A vacuum cleaner comprising:

a cleaner body having a suction motor;

a cleaner head configured to be in communication with the cleaner body and to suction air and dust;

a recess provided in the cleaner body and configured to selectively receive a batter assembly that has a battery, and to selectively receive a cord reel assembly that has a power cord to replace the battery assembly;

a controller configure to control the suction motor based on whether the battery assembly or the cord reel assembly is installed in the recess; and an inverter configured to supply a voltage received from one of the battery assembly or the cord reel assembly installed in the recess to the suction motor, wherein a body terminal is provided in the recess, a battery terminal which connects to the body terminal is provided at the battery assembly, and a cord reel terminal which connects to the body terminal is provided at the cord reel assembly, wherein each of the battery assembly and the cord reel assembly outputs DC voltage to the body terminal, wherein the cord reel assembly comprises an AC/DC converter for converting an AC voltage into the DC voltage for the cord reel assembly, and wherein the cord reel assembly comprises a base, and a rotating member which is rotatable relative to the base by a rotating shaft and on which the power cord is wound, and the AC/DC converter is disposed at a space formed at a central portion of the rotating member.

12. The vacuum cleaner according to claim 11, wherein the AC/DC converter comprises a printed circuit board, and the printed circuit board is installed at the base, and has a hole through which the rotating shaft passes.

13. A vacuum cleaner comprising:

a cleaner body having a suction motor;

a cleaner head configured to be in communication with the cleaner body and to suction air and dust;

a recess provided in the cleaner body and configured to selectively receive a battery assembly that has a battery, and to selectively receive a cord reel assembly that has a power cord to replace the battery assembly;

a controller configured to control the suction motor based on whether the battery assembly or the cord reel assembly is installed in the recess; and an inverter configured to supply a voltage received from one of the battery assembly or the cord reel assembly installed in the recess to the suction motor, wherein a body terminal is provided in the recess, a battery terminal which connects to the body terminal is provided at the battery assembly, and a cord reel terminal which connects to the body terminal is provided at the cord reel assembly, wherein a plurality of distribution resistors are connected to both ends of the body terminal, and wherein the controller determines whether the battery assembly or the cord reel assembly is installed in the recess based on a voltage between the plurality of distribution resistors.

* * * * *